US006362789B1

(12) United States Patent
Trumbull et al.

(10) Patent No.: US 6,362,789 B1
(45) Date of Patent: Mar. 26, 2002

(54) DUAL BAND WIDEBAND ADJUSTABLE ANTENNA ASSEMBLY

(75) Inventors: Thomas Trumbull, Redwood Estates; Dick Kuck, San Jose; Peter Fine, Santa Cruz; John E. Harris, Carmel, all of CA (US)

(73) Assignee: Rangestar Wireless, Inc., Aptos, CA (US)

( * ) Notice: Subject to any disclaimer, the term of this patent is extended or adjusted under 35 U.S.C. 154(b) by 0 days.

(21) Appl. No.: 09/747,092

(22) Filed: Dec. 22, 2000

(51) Int. Cl.[7] ..... H01Q 1/38
(52) U.S. Cl. ..... 343/700 MS
(58) Field of Search ..... 343/700 MS, 702, 343/846, 848, 853

(56) References Cited

U.S. PATENT DOCUMENTS 6,005,522 A * 12/1999 Arias et al. ..... 343/700 MS
6,140,966 A * 10/2000 Pankinaho ..... 343/700 MS
6,208,298 B1 * 3/2001 Uchino et al. ..... 343/700 MS

* cited by examiner

*Primary Examiner*—Don Wong
*Assistant Examiner*—Hoang Nguyen
(74) *Attorney, Agent, or Firm*—Fulbright & Jaworski LLP

(57) ABSTRACT

A dual frequency wideband antenna assembly for use in a wireless communication device. The antenna assembly having a first resonator element disposed away from the ground plane element, said first resonator element being operatively coupled at a first location to the ground plane and being operatively coupled at a second location to the RF signal port; a second resonator element disposed away from the ground plane. The first and second resonator elements are coupled via a bridge conductor and a capacitive tuning network. The capacitive tuning network may include a discrete capacitor or an adjustable capacitor which varies in response to a signal.

12 Claims, 6 Drawing Sheets

FIG. 5 TUNING NETWORK ASSEMBLY

DUAL BAND WIDEBAND ADJUSTABLE ANTENNA ASSEMBLY

FIELD OF THE INVENTION

The present invention relates to an antenna assembly suitable for wireless transmission of analog and/or digital data, and more particularly to a dual frequency, wideband resonator element providing at least one adjustably tuned component.

BACKGROUND OF THE INVENTION

Recent advances in wireless communications devices have renewed interest in antennas suitable for such systems. Several factors are usually considered in selecting an antenna for a wireless telecommunications device. Significant among these factors are the size, VSWR, gain, bandwidth, and the radiation pattern of the antenna.

Currently, monopole antennas, patch antennas and helical antennas are among the various types of antennas being used in wireless communications devices. These antennas, however, have several disadvantages, such as limited bandwidth and large size. Also, these antennas exhibit significant reduction in gain at lower elevation angles (for example, 10 degrees), which makes them undesirable in some applications.

As mentioned above, one type of antenna is an external half wave single or multi-band dipole. This antenna typically extends or is extensible from the body of a wireless communication device in a linear fashion. Because of the physical configuration of this type of antenna, electromagnetic waves radiate equally toward and away from a user. Thus, there is essentially no front-to-back ratio and little or no specific absorption rate (SAR) reduction. Specific absorption rates for this type of antenna are typically 2.7 mw/g at a 0.5 watt transmission power level. With multi-band versions of this type of antenna, resonances are achieved through the use of inductor-capacitor (LC) traps. With this antenna, gains of +2 dBi arc common. While this type of antenna is acceptable in some wireless communication devices, it has drawbacks. One significant drawback is that the antenna is external to the body of the communication device. This places the antenna in an exposed position where it may be easily damaged.

A related antenna is an external quarter wave single or multi-band asymmetric wire dipole. This antenna operates much like the aforementioned antenna, but requires an additional quarter wave conductor to produce additional resonances. This type of antenna has drawbacks similar to the aforementioned antenna.

SUMMARY OF THE INVENTION

A dual band antenna assembly for use in a wireless communications device (WCD) is disclosed. The antenna assembly provides simultaneous wideband resonances over two or more different frequency bands when disposed relative to a ground plane of the wireless communications device. One or more of the operational frequency bands of the antenna assembly may be selectively adjusted via a capacitive tuning network. The selective adjustment of the capacitive tuning network may be achieved during the manufacture or subsequent use of the wireless communications device. In this manner, a tuning process over a much wider range of frequencies in each band may be achieved without an alteration of the physical size or structure of the antenna element. The selectively tunable antenna according to the present invention permits a single mechanical embodiment to accommodate a variety of different frequency bands, thus providing a manufacturing and assembly economy over prior art antennas (where timing has typically required an alteration of the physical structure of the antenna, or selection from among a plurality of differently sized antenna elements). The selective tuning of the antenna assembly of the present invention may be achieved via a variety of automatic or manual approaches. In one embodiment, the capacitive tuning network, such as a varactor, may be electrically tuned via the WCD microprocessor in response to an internal program or one or more external signals. In another embodiment, the capactive tuning network may be controlled via a manual operated switch, such as through a PIN diode switching device.

The antenna assembly includes first and second conductive surfaces disposed relative the ground plane of the WCD, preferably at the upper rear portion of the WCD. The first and second conductive surfaces are in substantial collateral relation and include a conductive bridge element disposed therebetween. The first and second conductive surfaces are also operatively coupled together via a capacitive tuning network, as further described herein. A conducting feed element operatively connects the first conductive surface to a signal line of the WCD. The feed element includes a feed arm defining a 50 ohm feed point. The first conductive surface is further coupled to the ground plane of the WCD via a grounding element.

In another embodiment, the antenna assembly is spaced a predetermined distance from the ground plane of a printed wiring board, and is operatively connected thereto at several predetermined locations by several components. One component, a capacitor or tuning network, capacitively couples the second conductive surface to the ground plane. Another component, the feed point of the antenna, operatively couples the first conductive surface to the RF input/output port or terminal of the WCD. Additionally, a third component, a grounding element, operatively connects the second radiating element to the ground plane. Since the distance between the antenna assembly and the ground plane is a function of the particular frequencies or wavelengths in use, the space between the antenna assembly and the ground plane may vary depending on the frequency band desired. However, it will be appreciated that various componentry may be positioned within the open space(s) between the antenna assembly and the ground plane to facilitate compact construction.

It is an object of the present invention to provide an antenna assembly which may be incorporated within the interior of a wireless communication device.

It is an object of the present invention to enhance operation of an antenna assembly by increasing its operational bandwidths and performance thereof.

It is another object of the present invention to provide an antenna assembly exhibiting at least one major polarization and one minor polarization.

Yet another object of the present invention is to provide a multiple band antenna for wireless communications devices that exhibits lower specific absorption rate (SAR) as compared to typical external antennas.

It is another object of the present invention to provide a multiple band antenna assembly wherein at least one of the frequency bands is selectively tunable by manual control or electrically tunable variable capacitor element.

It is yet another object of the present invention to provide a control assembly for adjusting the capacitance of the electrically tunable variable capacitor element, such as a digital control structure.

It is another object of the present invention to provide a variable capacitor element control assembly which is responsive to external signals received from the wireless communications system.

It is yet another object of the present invention to provide a variable capacitor element control assembly which is response to internal signals of the wireless communications device.

A feature of the present invention includes the provision that one or more portions of the resonator elements of the antenna assembly are tunable over a broad range of frequencies.

Another feature of the present invention includes the provision of a single feed point for a multi-band antenna system. The multiple band antenna assembly according to the present invention may exhibit a VSWR of approximately 2:1 over two different frequency bands, such as 880–960 MHz and 1710–1880 MHz or 824–894 MHz and 1850–1990 MHz. These and other objects, features and advantages will become apparent in light of the following detailed description of the preferred embodiments in connection with the drawings.

DETAILED DESCRIPTION OF THE PREFERRED EMBODIMENTS

Figure 1:
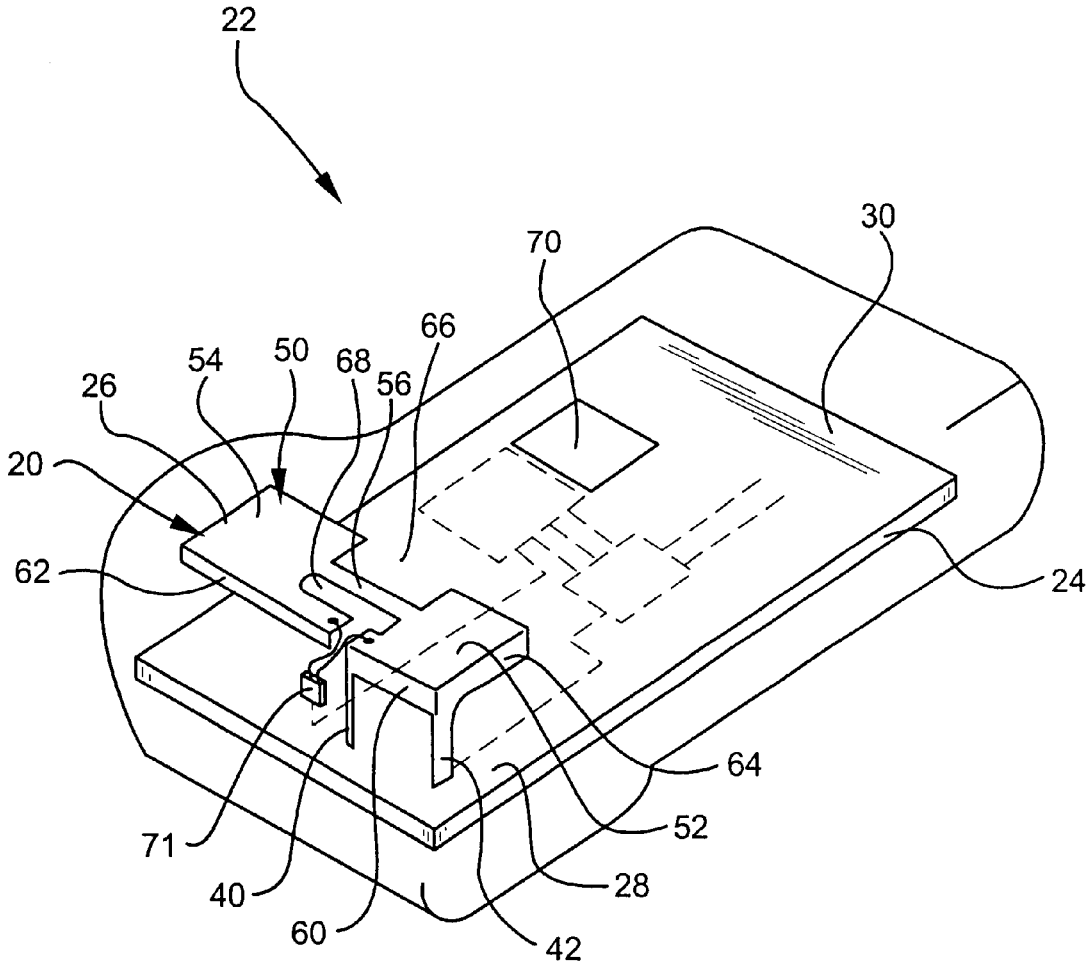
FIG. 1 is a perspective view of an antenna assembly according to the present invention disposed within a wireless communications device.
Figure 2:
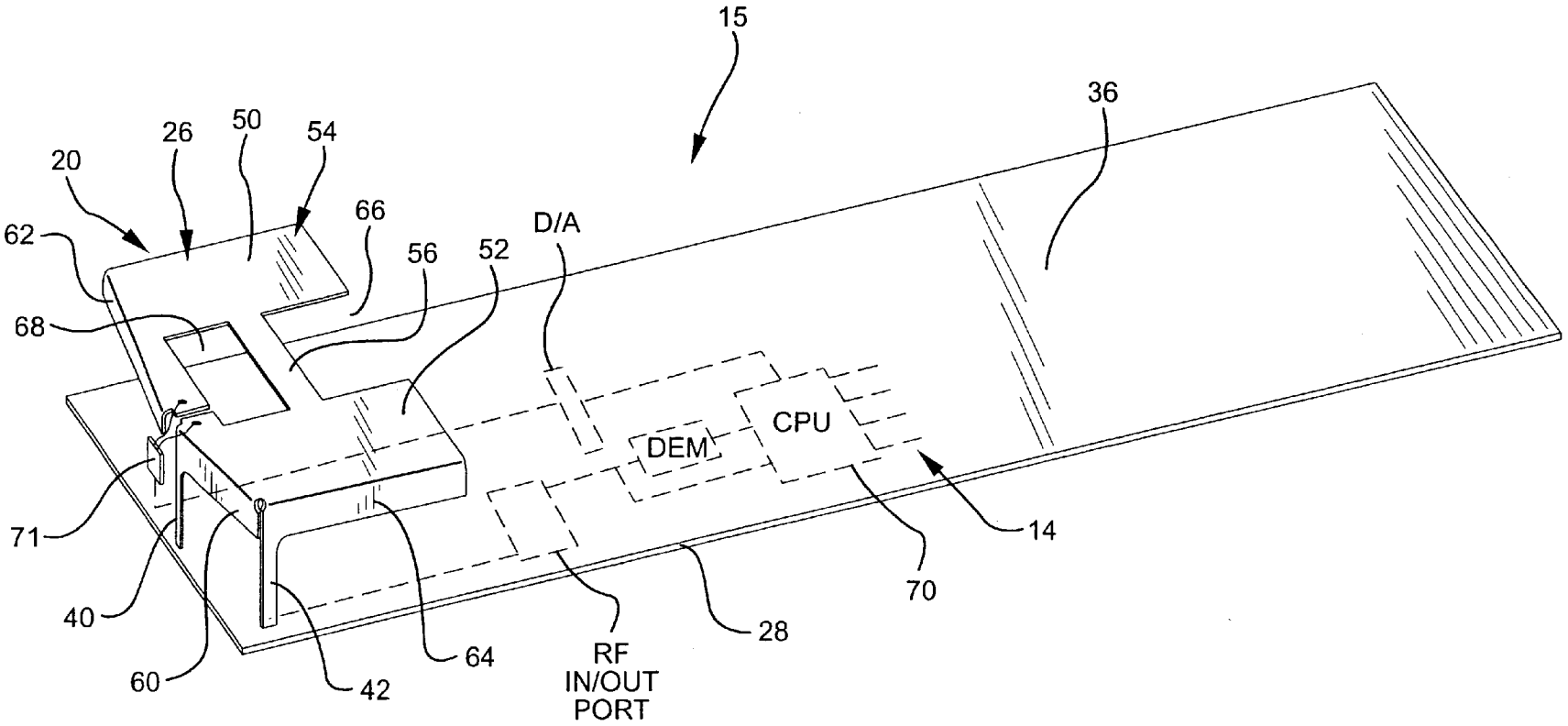
FIG. 2 is a perspective view of the antenna assembly according to the present invention disposed upon a printed circuit board assembly.

Referring now to the drawings, wherein like numerals depict like parts throughout, FIG. 1 illustrates an antenna assembly 20 according to the present invention disposed near the upper rear portion of a hand-held wireless communications device 22. The antenna is disposed within the housing 24 of the wireless communications device 22. The antenna assembly 20 according to the present invention includes a resonator structure 26 disposed relative to a ground plane 28 of the wireless communications device 22. As depicted, the resonator structure 26 of the antenna assembly 20 is disposed at an upper end portion of a printed wiring board (PWB) 30 and is operatively coupled to the PWB 30 by a pair of conducting elements 40, 42, including a grounding conductor 40 and a feed conductor 42. Feed conductor 42 element includes a first end which is operatively connected at a predetermined position along an edge 64 of the resonator structure 26. The other end of the feed element 42 is operatively connected to the PWB 30 at the RF 50 ohm input/output terminal or port. The feed element 42 is illustrated as an integrated planar portion of the resonator structure 26, though an alternative feed element 42 may include a coaxial cable, a microstrip line, or other suitable conductors. The grounding element 40 has two ends, one end of which is operatively coupled to a portion of the resonator structure 26 of the antenna assembly 20. The other end of the grounding element 40 is operatively connected near the top of the PWB 30 to the ground plane 28 in a conventional manner.

The resonator element 26 of the antenna assembly 20 includes a substantially planar top surface 50 defining two separated conductive regions 52, 54. The two conductive regions 52, 54 are coupled together via a conductive bridge element 56 and a capacitive tuning network 71. Resonator element 26 can include first and second front surfaces 60, 62 and a side surface 64. Resonator structure 26 further defines a pair of removed portions 66, 68, the physical size of which may be varied depending on the particular application. The two conductive regions 52, 54 are disposed in a side-by-side relationship and are operatively coupled by the conductive bridge element 56 and by a capacitor for fixed tuned operation or a capacitive tuning network 71 for electrically tuned function. Conductive bridge element 56 is illustrated as an integrated planar portion of resonator structure 26. Alternative embodiments may include a bridge element 56 being a separate conductor, such as a wire, having different dimensions as compared to the bridge element 56 of FIGS. 1–4.

The first conductive region 52 is sized to resonate at the lower frequency band. The second conductive region 54 is sized to resonate at the higher frequency band and is functionally dependent on the capacitive tuning network 71 coupled between the first and second conductive regions 52, 54. In one embodiment, a variable capacitive tuning network 71 has range of approximately 0.7–1.4 picofarads for operation over the 1710–1800 MHz frequency band. Importantly, the capacitance value of the capacitive tuning network 71 is capable of being selectively varied to tune the resonator over a range of frequencies without changing the physical characteristics of the resonator 26. In preferred embodiments, the capacitive tuning network 71 may be controlled via a user-manipulated switch, or even via an internal digital controller 70. In one embodiment, a digital controller 70 may receive control input from the user, an internal program, or from an external signal such as from a cell phone system or wireless datalink base station. The external signal may be extracted from a separate transmitted signal which is received by the antenna 20 or even defined as a portion of or contained within the communication protocol.

Figure 4:
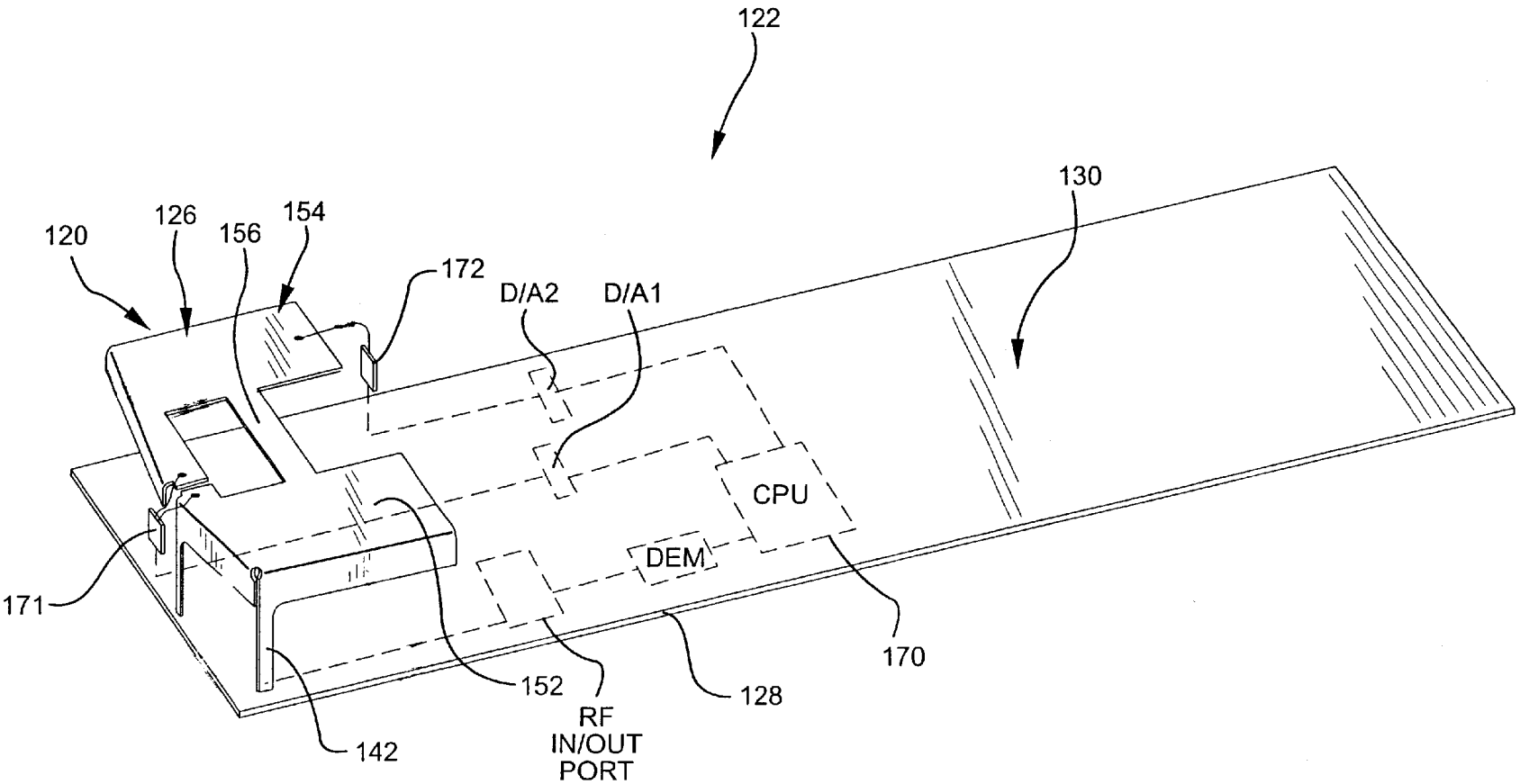
FIG. 4 is a perspective view of another embodiment of an antenna assembly according to the present invention disposed on a printed circuit board assembly.
Figure 5:
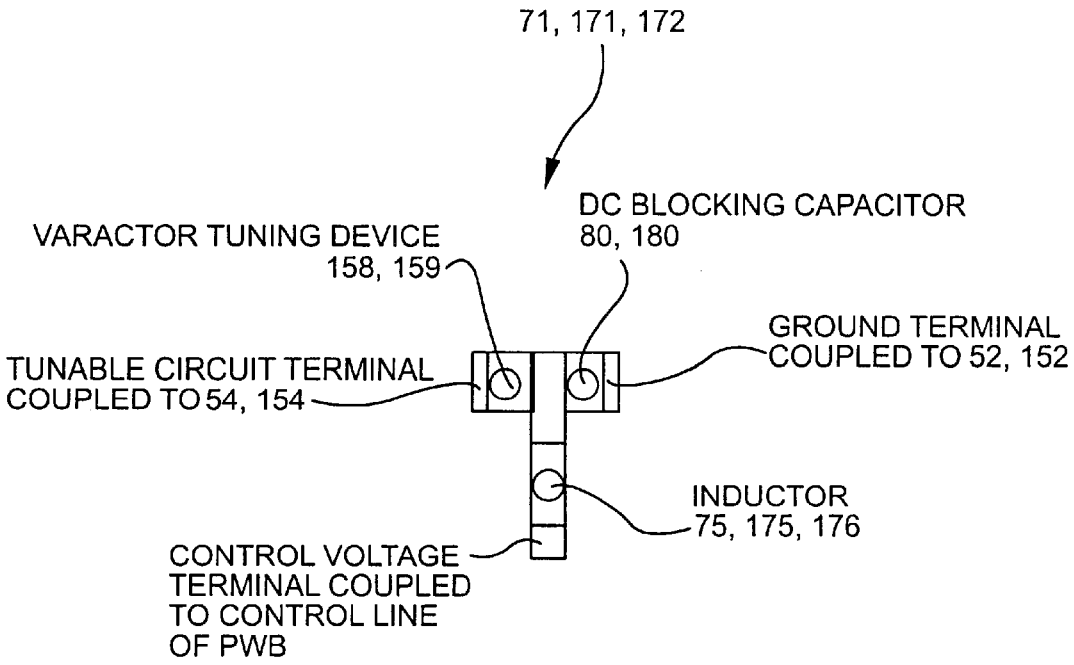
FIG. 5 is a schematic diagram of a capacitive tuning network for use with the antenna assembly according to the present invention.

FIG. 5 illustrates one possible capacitive tuning network 71 for use with the antenna assembly 20. The two conductive regions 52, 54 of FIG. 4 are capacitively coupled together by the capacitive tuning element 158, and a DC blocking capacitor 159 which are components of the tuning network 71. Capacitive tuning element 158 may be a varactor element. Analog tuning network 17 of antenna assembly 120 further includes an inductor or RF choke 75 which allows a control voltage to vary the capacitance of the varactor capacitive tuning element 158. The value of the control voltage may be controlled via a digital controller, D/A and/or CPU or manual switching, as appreciated by those skilled in the relevant arts.

In another embodiment, the capacitive tuning network 71 and associated control device 70 may be automatically responsive to a continuously or semi-continuously transmitted signal to aid in maintaining the signal quality, change of protocol of the communications link or to enable encryption. In this regard, a single resonator element 26 may be used to achieve relatively seamless transitions or "hand-offs" as the wireless communication device 22 is used between differing RF spectra, encryption, and/or communications protocols.

Figure 3:
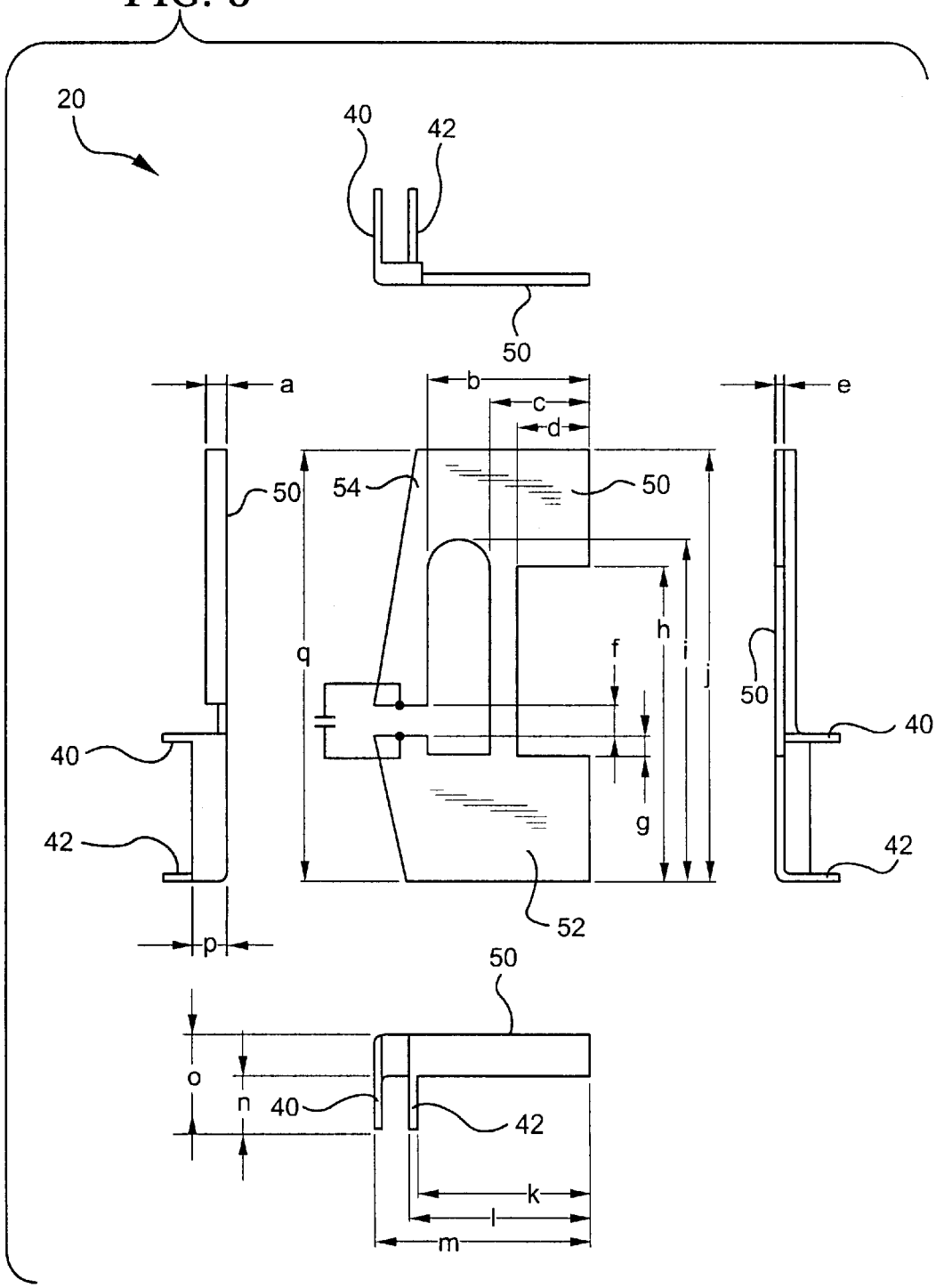
FIG. 3 is views of a resonator portion of the antenna assembly of FIG. 1.

The antenna assemblies 20, 120 of FIGS. 1–4 are sized to exhibit a VSWR of approximately 2:1 over two different frequency bands, such as 880–960 MHz and 1710–1880 MHz or 824–894 MHz and 1850–1990 MHz. FIG. 3 illustrates views of the resonator element 26 of the antenna assembly 20 of the present invention. Dimensions of the features of the components indicated in FIG. 3 are as follows:

| Item | Dimension (in.) |
|---|---|
| a | .075 |
| b | .57 |
| c | .36 |
| d | .248 |
| e | .010 |
| f | .068 |
| g | .05 |
| h | 1.00 |
| i | 1.1 |
| j | 1.42 |
| k | .602 |
| l | .64 |
| m | .76 |
| n | .315 |
| o | .449 |
| p | .137 |
| q | 1.33 |
| r | 0.7 pF |

FIG. 4 illustrates another embodiment of the antenna assembly 120 according to the present invention. As depicted in FIG. 4, the antenna assembly 120 includes a resonator structure 126 disposed relative to a ground plane 128 of the wireless communications device 122. As depicted, the resonator structure 126 of the antenna assembly 120 is disposed at an upper end portion of a printed wiring board (PWB) 130 and is operatively coupled to the PWB 130 by a feed conductor 142. Feed conductor element 142 includes a first end which is operatively connected at a predetermined position along an edge of the resonator stricture 126. The other end of the feed element 142 is operatively connected to the PWB 130 at the RF input/output terminal or port. The feed element 142 is illustrated as an integrated planar portion of the resonator structure 126, though alternative feed elements may include a coaxial cable, a microstrip line or other suitable conductors.

The resonator element 126 of FIG. 4 includes a substantially planar top surface 150 defining two separated conductive regions 152, 154 coupled together via a bridge element 156 and a tuning network 171, which includes a capacitive tuning element 158 (See, FIG. 5). Bridge element 156 of FIG. 4 is illustrated as an integrated planar portion of resonator structure 156. Alternative embodiments may include a bridge structure 156 being a separate conductor, such as a wire, having different dimensions as compared to the bridge element 156 of FIG. 4.

As illustrated in FIG. 5, the two conductive regions 152, 154 of FIG. 4 may be capacitively coupled together by the capacitive tuning element 158, and DC blocking capacitor 159 which are components of the tuning network 171. Capacitive tuning element 158 may be a varactor element. Analog tuning network 171 antenna assembly 120 further includes an inductor or RF choke 175 which allows a control voltage to vary the capacitance of the varactor capacitive tuning element 158. The value of the control voltage may be controlled via a digital controller, CPU, or manual switching, as appreciated by those skilled in the relevant arts.

The antenna assembly 120 further includes a second tuning network 172 which is coupled between the second conductive region 154 of the resonator 126 and the ground plane 128 of the wireless communications device 122. The second varactor 159 on tuning network 172 may be controlled in similar manner to the first varactor element 158, i.e., via RF choke 176, a controllable voltage via digital controller, D/A, and CPU.

Figure 6:
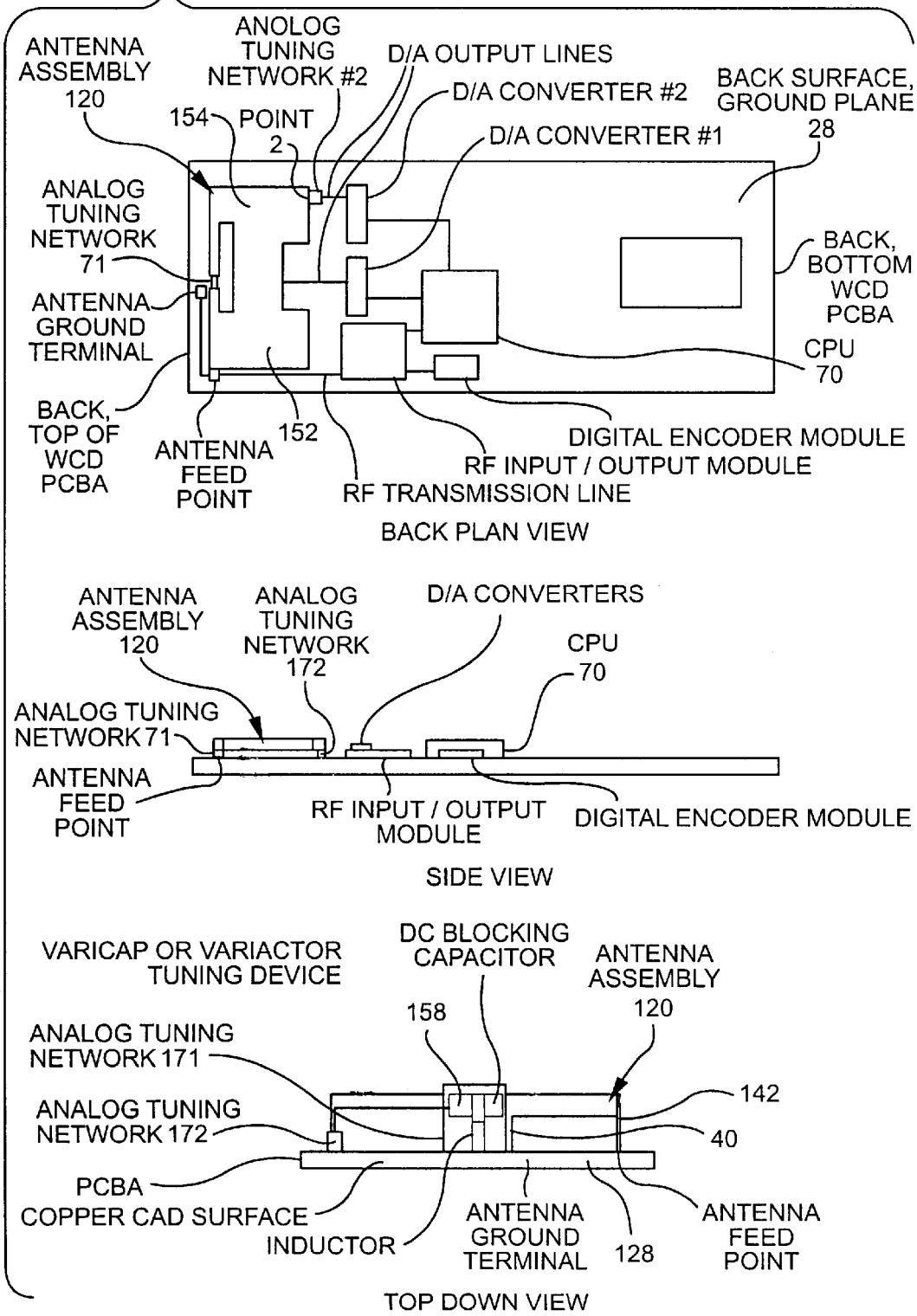
FIG. 6 includes back plan, side, and top elevational views of an antenna assembly according to the present invention.

FIG. 6 includes back plan, side, and top elevational views of an antenna assembly according to the present invention. The view of FIG. 6 are not necessarily to view, but illustrate possible orientations and components of a wireless communications device including an antenna assembly according to the present invention.

It should be noted that the drawings may indicate proportions and dimensions of components of the antenna device. However, e.g., thickness of conductive layers have been exaggerated for clarity. Although, in many embodiments conductive plates have been mentioned, it is understood that it includes the use of conductive layers, possibly attached to dielectric substrate(s). Although the invention is described by the above examples, naturally, a skilled person would appreciate that many other variations than those explicitly disclosed are possible within the scope of the invention.

Additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed:

1. A wideband adjustable antenna assembly for use in a wireless communications device, said device having an input/output RF signal port and a ground plane, said antenna assembly comprising:

a first resonator element disposed away from the ground plane element, said first resonator element being operatively coupled at a first location to the ground plane and being operatively coupled at a second location to the RF signal port;

a second resonator element disposed away from the ground plane;

a bridge conductor conductively coupling the first and second resonating elements; and a capacitive tuning network operatively coupled to the first and second resonating elements, said capacitive tuning network capacitively coupling the first resonating element to the second resonating element.

2. The antenna assembly of claim 1, wherein the capacitive tuning network is a discrete capacitor having a preselected capacitance value selected with reference to one or more frequency bands of operation.

3. The antenna assembly of claim 2, wherein the capacitive tuning network defines a plurality of capacitance values associated within one or more frequency bands of operation.

4. The antenna assembly of claim 3, wherein the capacitive tuning network includes a manual operated switch to select a preferred capacitance value.

5. The antenna assembly of claim 4, wherein the capacitive tuning network includes a PIN diode switch device.

6. The antenna assembly of claim 3, wherein the capacitive tuning network includes an electrically adjustable capacitor.

7. The antenna assembly of claim 6, wherein the electrically adjustable capacitor is a varactor.

8. The antenna assembly of claim 6, wherein the electrically adjustable capacitor is varied in response to a signal.

9. The antenna assembly of claim 8, wherein the signal is an external signal associated with a particular wireless communications protocol and received by the wireless communications device.

10. The antenna assembly of claim 8, wherein the signal is an internal signal associated with an internal program of a microprocessor.

11. The antenna assembly of claim 1, wherein the first and second resonator elements are substantially coplanar.

12. The antenna assembly of claim 1, wherein the first and second resonator elements and the bridge conductor are substantially coplanar.

* * * * *